United States Patent [19]

Zimmermann et al.

[11] Patent Number: 4,662,411

[45] Date of Patent: May 5, 1987

[54] ASSEMBLY FOR LIQUID RECOVERY FROM ASEPTICALLY PACKAGED BEVERAGE

[75] Inventors: Craig E. Zimmermann, Chaska; Stanley C. Rustad, Golden Valley; Loren J. Gordon, Maple Grove, all of Minn.

[73] Assignee: General Mills, Inc., Minneapolis, Minn.

[21] Appl. No.: 732,975

[22] Filed: May 13, 1985

[51] Int. Cl.[4] ..... B65B 31/08; B65B 35/00; B65B 43/48

[52] U.S. Cl. ..... 141/66; 137/209; 141/129; 141/59; 141/130; 141/98; 141/285

[58] Field of Search ..... 137/209, 206; 141/129, 141/130, 98, 329, 285, 37, 59, 65, 66, 163, 168, 1, 4, 6, 7

[56] References Cited

U.S. PATENT DOCUMENTS

| | | | |
|---|---|---|---|
| 3,057,588 | 10/1962 | Kolbe | 137/209 X |
| 3,596,673 | 8/1971 | Laucournet | 137/209 |
| 3,872,730 | 3/1975 | Ringrose et al. | 73/864.23 |
| 3,880,179 | 4/1975 | Lenz et al. | 141/1 X |
| 3,916,960 | 11/1975 | Thompson | 141/65 X |
| 4,160,382 | 7/1979 | Finsterwalder et al. | 141/130 X |
| 4,216,792 | 8/1980 | Siminovich | 137/209 |
| 4,274,453 | 6/1981 | Lee | 141/1 |
| 4,342,341 | 8/1982 | Lee | 141/1 |
| 4,519,427 | 5/1985 | Ono et al. | 141/65 |

*Primary Examiner*—Charles E. Phillips
*Assistant Examiner*—Ernest G. Cusick
*Attorney, Agent, or Firm*—John A. O'Toole

[57] ABSTRACT

Disclosed are apparatus for recovering beverages from cases of defective aseptic packages such as caused by mismarking. The apparatus comprises a plurality of hollow needle pairs which both puncture the packages. One needle of the needle pair supplies air to the package forcing the beverage to exit through the other needle. The apparatus further includes means for advancing and retracting the needle pairs. The apparatus is pneumatically controlled and powered.

7 Claims, 7 Drawing Figures

84
82
120
86
88
116
80
40
94
98
99
96
102
81
104
118
132
100
101
106
90
92
54
43
74
76
16
18
15
15

ASSEMBLY FOR LIQUID RECOVERY FROM ASEPTICALLY PACKAGED BEVERAGE

BACKGROUND OF THE INVENTION

1. Field of the Invention

In its apparatus aspect, the present invention relates to apparatus for treating foods and beverages. More particularly, the present invention relates to apparatus for emptying cases of cartons containing beverages by puncturing with needles which pneumatically expunge the beverage from the cartons. In its method aspect, the present invention pertains to pneumatic methods for emptying aseptically packaged beverages.

2. The Prior Art

Aseptically boxed shelf stable beverages have been popular in Europe for years. Recently, such packaging has become increasingly popular in America especially to package fruit juices. Among the advantages of aseptically packaged beverages are a long shelf life and the convenience of room temperature storage compared to refrigeration.

Typically, individual servings, e.g., 8 to 12 oz. (vol.), are individually packaged in cartons or boxes. Shrink-wrapped, multi-packs, e.g., four or six packs, are also popular. Cases typically comprise a plurality, e.g., six, of multi-packs.

In commercial production, many packages of beverages are manufactured having material defects which prevent their being of commercial quality but which do not involve the quality of the contained beverage. Such defects might include packaging one type juice, e.g., orange juice, in a packaging indicating another juice type, e.g., grape. The packaging graphics may be merely smeared or otherwise defective. It would then be desirable to recover or recoup the valuable beverage from the defective containers.

At present, beverage recovery equipment involves large containers with compression means whereby cases of carton packaged beverages are crushed and the juice allowed to drain into a "recoup" tank. While effective to recoup certain amounts of the valuable beverage, the known apparatus and techniques for beverage recoup suffer from several disadvantages. Recoup yields are relatively low using present techniques. Low recoup yields are due in part to large percentages of packages which are not ruptured or which are only partially emptied. Recoup yields can be increased by additional hand drainings. However, such hand draining is messy and very labor intensive requiring sorting among mixed, drained, full and partially drained packages.

Present recoup apparatus and techniques suffer from another significant disadvantage. Present recoup technology necessitates considerable exposure of the beverage to the packaging exterior. During normal packaging procedure, the packages are conveyed over machinery typically washed with strong detergents. The packages necessarily pick up minor amounts of these detergents or other grime or grease. Contact between the beverage and package exterior results in beverage contamination even when the best manufacturing and sanitation practices are employed. The recouped beverage must then be treated to clean the beverage. In addition to being an additional expense, decontamination of sensitive beverages can result in loss of beverage flavor and/or color quality.

Surprisingly, it has been discovered that the above disadvantages can be overcome by adopting a new approach to emptying beverage aseptic packages. The present invention provides beverage recoup apparatus which pneumatically exhausts the beverage from the package. Virtually 100% of the packages are substantially drained. Recoup yields of 95% and above are possible. Additionally, the present apparatus minimizes contact between the beverage and the package exterior resulting in dramatically decreased contamination.

Of course, while the present invention is especially suitable for use in connection with aseptically packaged beverages especially juices, it is to be appreciated that the present invention can also be used for recouping other beverages or liquids packaged in small paper or paper/foil cartons, e.g., milk in 8 oz. paper cartons.

DESCRIPTION OF THE PREFERRED EMBODIMENTS

In its apparatus aspect, the present invention relates to apparatus which are useful in recovery of cased beverages packaged in defective aseptic packages. The apparatus pneumatically exhausts the beverages from each of the cased packages using air supply and beverage exhaust paired needles for each package.

Figure 1:
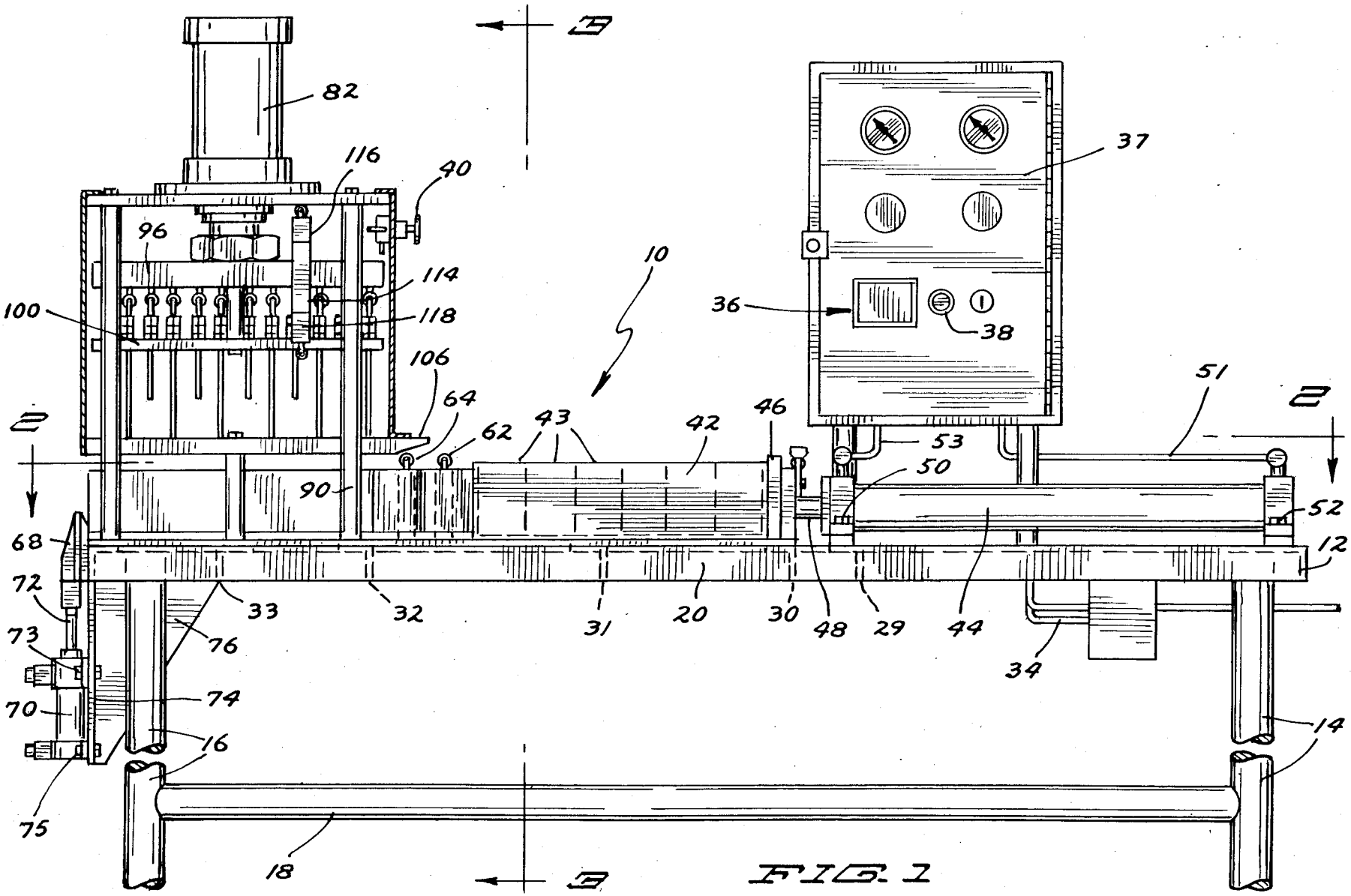
FIG. 1 is a side elevational view, with the upper housing partially removed, of one embodiment of the present beverage recoup apparatus in an open position and showing a case of beverage packages being conveyed for beverage recoup.

Referring now to the drawings, and to FIG. 1 in particular, there is shown an embodiment of the present beverage recoup apparatus or juice recouper which is designated generally by reference numeral 10. Included in the apparatus is a frame 12 conventional in design for supporting the various mechanisms hereinafter described and being composed of a number of tubular members such as vertical support members 14 and 16 and horizontal support member 18. The vertical support members 14 and 16 can be supplied, if desired, with conventional leveling bolts 15, (see FIG. 3) so as to provide the apparatus with a slight incline, e.g., about 3°, for reasons described below. As is common in food processing equipment, the apparatus is constructed with stainless steel as much as possible unless otherwise indicated.

Figure 2:
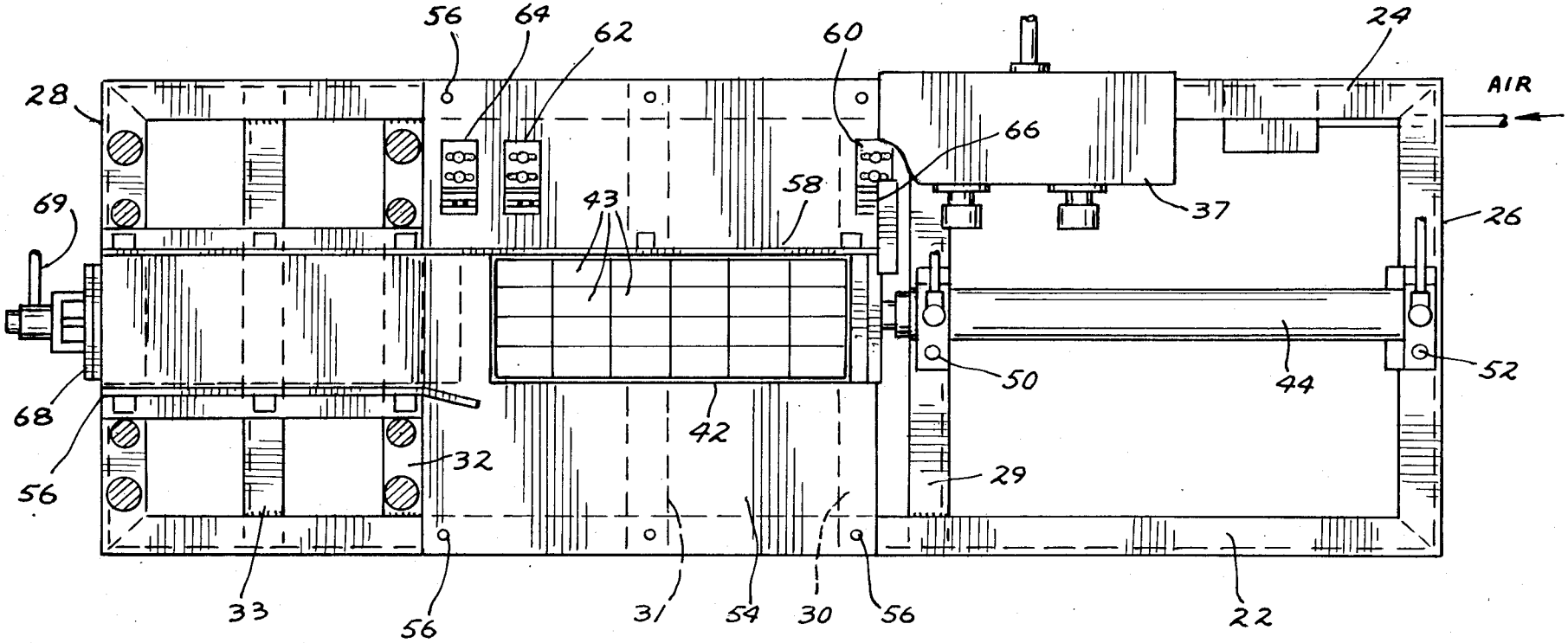
FIG. 2 is a cross sectional view of the apparatus taken along lines 2—2 of FIG. 1 with a portion of the pneumatic controller partially cut away.

Referring now briefly to FIG. 2 to further describe the frame 12, it can be seen that the frame 12 additionally includes a plurality of horizontal support members including an opposed pair of longitudinally extending members 22 and 24 and a plurality of spaced laterally extending crossbar members including an opposed pair of end members 26 and 28 and a plurality of intermediate spaced laterally extending crossbar members 29–33.

The apparatus is completely powered pneumatically. The air supply is desirably clean, degreased, filtered air supplied at about 60–100, preferably 80 psig (653 KPa.) and is fed to the apparatus 10 through air supply line 34. Referring now back to FIG. 1, it is shown that the apparatus additionally includes a pneumatic controller 36. Regulation of the air supply pressure can be accomplished through a pneumatic control panel 37 which utilizes conventional regulator means, e.g., regulator valves with filters. The pneumatic controller 36 is conventional in design and construction and the precise construction of the present pneumatic controller 36 is not part of the present invention. Pneumatic controllers useful herein are available from Festo Corp. The pneumatic controller 36, of course, serves to pneumtically control operation of the present invention through the operation steps described herein using air from the air supply.

Still referring to FIG. 1, as a safety feature, a first palm switch 38 is positioned on the face of the control panel 37 while an emergency stop second palm switch 40 is distally positioned, but pneumatically connected to the controller 36. Of course, the emergency stop switch 40 allows for immediate stopping of the apparatus should any occasion occur requiring such action.

FIG. 1 further shows a case 42 comprising six, beverage four-pack packages 43 from which the beverage is to be recovered. The case 42 is advanced by advancing means such as a double acting pneumatic cylinder 44. The advancing means further includes a push plate 46 fastened to a piston 48 of the pneumatic cylinder. The pneumatic cylinder is fastened to the frame 12 such as by bolts 50 and 52 and powered by air from air supply and discharge lines 51 and 53 which are pneumatically connected to the pneumatic controller 36.

Referring now to FIG. 2, it can be seen that the apparatus 10 further includes a first or lower support plate 54 affixed to the frame 12 by bolts 56. The support plate can be fabricated from ultra high molecular weight polyethylene due to its slippery surface yet high abrasion and wear resistance. The apparatus 10 further includes an opposed pair of longitudinally extending channel guides 56 and 58 for controlled advancement of the case. Channel guide 56 is shorter than guide 58. The additional length of guide 58 serves as a stop for the case 42 upon its loading onto the apparatus 10. The channel guides 56 and 58 can be fabricated from coated stainless steel, e.g., Teflon TM or Suprelon TM polyfluoride coatings which provide reduced friction to the case's 42 movement.

FIG. 2 further depicts a first, second and third pneumatic limit switches 60, 62 and 64 which are used in control of the operation of the apparatus 10 as described below. The limit switches are pneumatically connected to the pnematic controller 36 by air supply lines which are not shown. The limit switches are tripped or activated by a trip bar 66 which is mounted on the push plate 46. FIG. 2 further depicts in relief the positioning of the case 42 after having been advanced by the action of the pneumatic cylinder 44. The advancing motion of the case 42 is controlled or stopped by the action of case stop plate means described immediately below.

Figure 5:
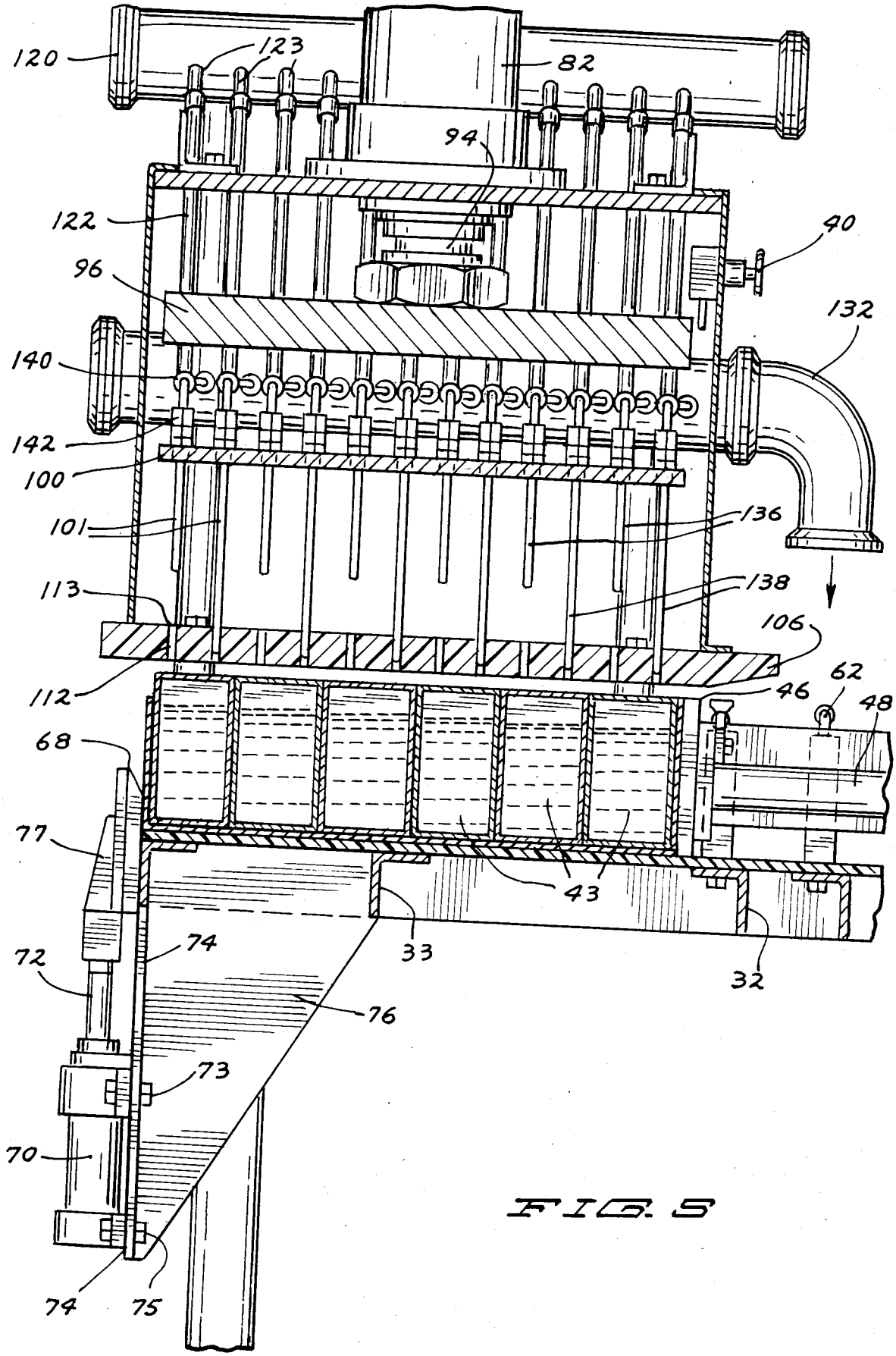
FIG. 5 is an enlarged, partial cross sectional view taken in the direction of 5—5 of FIG. 4 showing the sides of the cased beverage packages and showing the needles in an open or retracted position.

Referring now briefly to FIG. 5, said case stop means can comprise a stop plate 68 fastened to a second or stop pneumatic cylinder 70 which is also pneumatically connected and controlled by the pneumatic controller 36 (not shown) from air supply lines 69 and 71. The cylinder 70 is affixed to the frame 12 by being fastened, e.g. bolts pairs 73 and 75, to a downwardly extending plate 74 which in turn is fastened to the frame 12 by conventional means such as welding to end support member 28. Additional support to the plate 74 is provided by a second downwardly projecting support plate 76 (shown in FIG. 6) also gusset welded to frame 12 and perpendicular to the plane of plate 74. A support plate 77 has a rounded portion 78 having a threaded, female portion (not shown) at its lower end which screws onto a threaded portion of a cylinder rod 72 of cylinder 70 at one end while support plate 74 at its upper end is fastened to stop plate 68 with machine screws (not shown).

Figure 3:
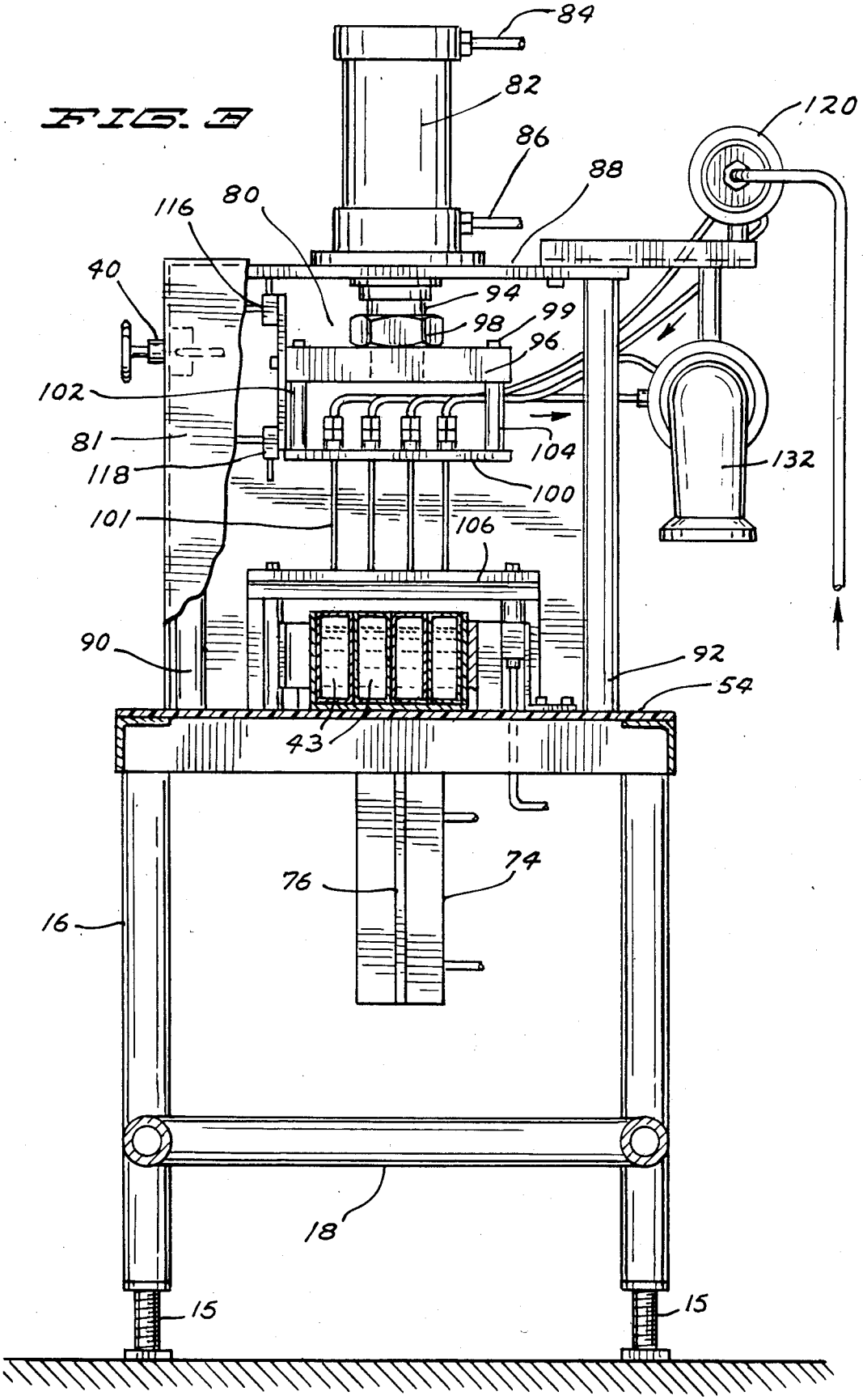
FIG. 3 is a cross sectional view of the apparatus taken in the direction of lines 3—3 of FIG. 1 with the cover partially cut away.

Reference is now made to FIG. 3 which shows a pneumatic, reciprocating needle platen sub-assembly designated generally by reference number 80. Surrounding the sub-assembly 80 is a cover or housing 81 greatly cut away to better show the sub-assembly 80. The sub-assembly comprises a double action pneumatic cylinder 82 which is pneumatically controlled by the pneumatic controller (not shown), through air supply lines 84 and 86. The pneumatic cylinder 82 is conventionally fastened to support plate 88 such as by bolts. The top support plate 88 is spaced apart, above and parallel to the plane of the case support plate 54 by means of a first and second pair of opposed and spaced vertical support members or pillars 90 and 92. The cylinder 82 has a threaded piston rod 94. A piston cylinder support plate 96 is fastened to the piston rod 94 by means of a large nut 98 which is tightened to the upper surface of the piston cylinder support plate 96. Spaced apart from and parallel to the support plate 96 is a needle platen or platen plate 100 which is supported by a first and second pair of spaced and opposed vertical support members 102 and 104 welded at their lower end of the needle platten 100. The vertical support members have threaded bores. Screw bolts 99 extend through corresponding holes in the needle platen 100 into the threaded bores of the vertical support members to secure the needle platen 100 to the support plate 96. The needle platen 100 supports a plurality of needle pairs 101 by means and whose operation are described further below.

Referring now again to FIG. 4, it is seen that the sub-assembly 80 additionally comprises a horizontal stripper plate 106 which is spaced above and parallel to the case support plate 54 by means of an opposed pair of spaced vertical support members 108 and 110. In relief is shown the extended or downwardly directed action of the needle pairs 101 piercing through corresponding and aligned bores 112 in the stripper plate when the cylinder 82 is in its advanced or extended position. The stripper plate is desirably fabricated from ultra high molecular weight polyethylene.

Figure 4:
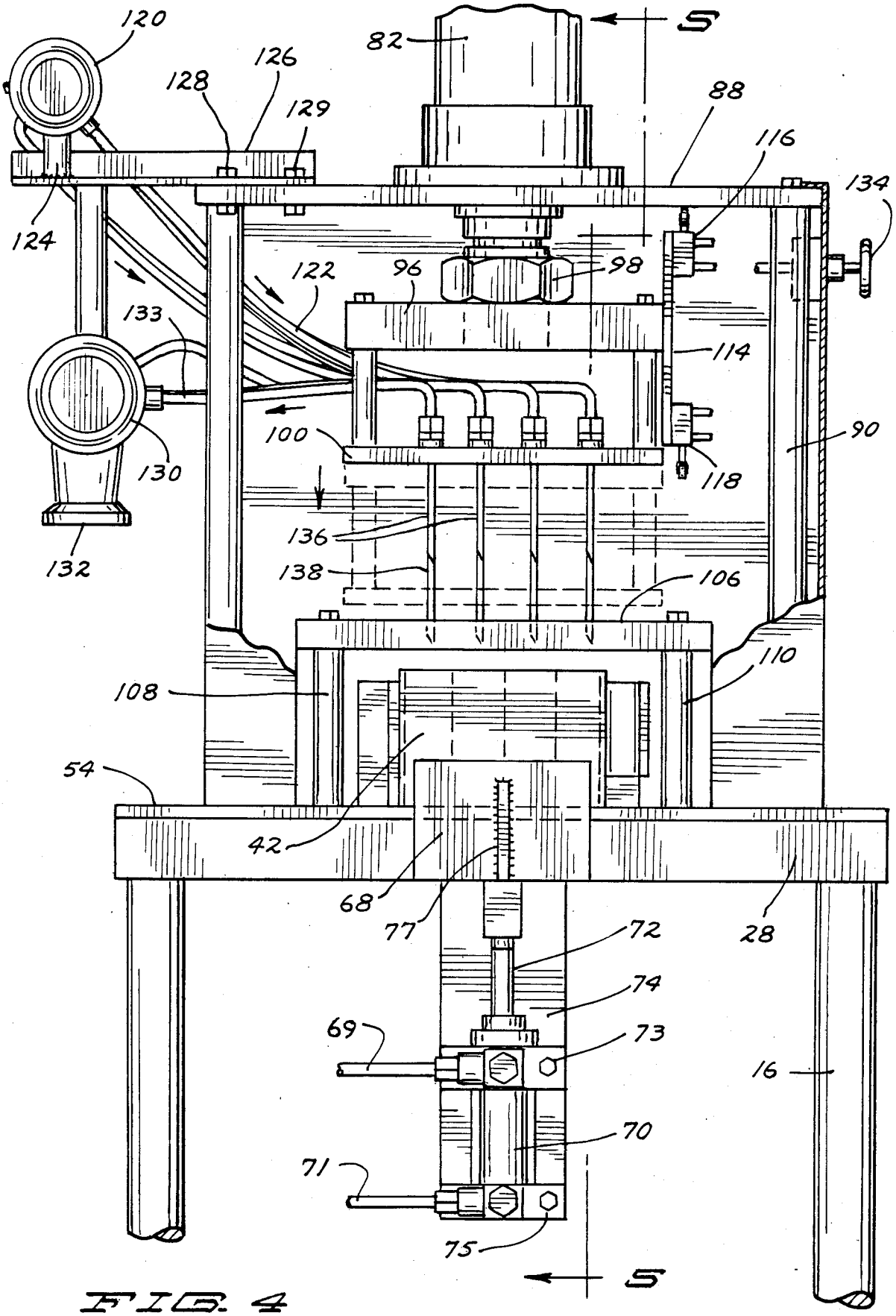
FIG. 4 is an enlarged, partial end view of the apparatus with the protective housing cover partially removed and showing in relief the apparatus in an engaged position.

FIG. 4 further depicts that fastened to the piston cylinder support plate 96 is a limit switch vertical support plate 114. The support plate 114 carries a fourth and fifth limit switches 116 and 118 which are also each pneumatically connected to the pneumatic controller. As the pneumatic cylinder 82 extends the piston rod 94 downward, the limit switch 118 eventually contacts the top surface of the stripper plate 106 and sends a position signal to the controller. At the end of the timed carton exhaust step described below, the controller will cause the double acting pneumatic cylinder 82 to retract. When the limit switch 116 is activated by contact with the lower surface of the cylinder support plate 88, a position signal is sent to the controller. The pneumatic cylinder 82 in operation extends its full stroke and retracts completely. The limit switches 116 and 118 only signal to the controller when it is extended or contracted.

FIG. 4 also depicts an air supply means to the needle pairs 101 such as pressurized air supply manifold 120 and a plurality of air supply lines 122 each of which is connected to one member of the needle pairs 101. The air supply manifold 120 shown includes a plurality of outwardly projecting pipes connected to plastic tubes by conventional means such as hose clamps (not shown). The air supply manifold 120 is supported by a pair of vertical support members 124 each fastened to a pair horizontal, outwardly extending support members 126, e.g. angle iron, fastened, with bolts 128 and 129 to the cylinder support plate 88. Projecting downward from support members pair 126 is a downwardly projecting vertical support member carrying a juice product collection manifold 130. Attached to the collection manifold 130 are a plurality of juice product collection lines 133 each of which are connected to the other members of the needle pairs 101. The collection manifold 130 further includes a downwardly projecting product exhaust pipe 132 such as a 90° elbow through which the product recouped juice is discharged to appropriate collection means (not shown) such as tanks or drums.

FIG. 4 also shows a third palm switch 134 which is also pneumatically connected to the controller. As a preferred safety feature, apparatus 10 operation commencement requires both palm switch 38 (not shown), and palm switch 134 to be simultaneously activated so as to render impossible apparatus to start-up with the operator's hand in an unsafe location.

Reference is now made to FIG. 5 wherein the piston rod 94 is shown fully retracted. As can be seen the apparatus comprises a number of needle pairs 101 equal in number to the number of packages of juice to be drained. While the present apparatus depicted is adapted to recoup juice or other beverages or liquids from cartons containing twenty-four packages, the skilled artisan will appreciate that apparatus within the scope of the present invention can be constructed with any number of needle pairs in any number of configurations.

As can be seen in FIG. 5, each needle pair 101 comprises a short needle 136 and a long needle 138. The short needles 136 are connected to the air supply lines 122 while the long needles are connected to the product collection lines 133. In the preferred embodiment, for better sanitation, the needles comprise single pieces of pipe 140 which extend through the needle platen 100. The pipe pieces 140 are secured to the needle platen 100 by fasteners 142 which screw into threaded bores in the needle platen 100. The other or pointed ends of the needles 136 are aligned with needles 138 which extend partially through the bores 112. As can be seen, the upper portion of the bores 112 have a portion partially flared 113 as a means of guiding the needles 136 and 138 into the bores 112. The upper ends of the pipe pieces 140 are connected to the air supply and collection lines by conventional means such as hose clamps (not shown).

Figure 6:
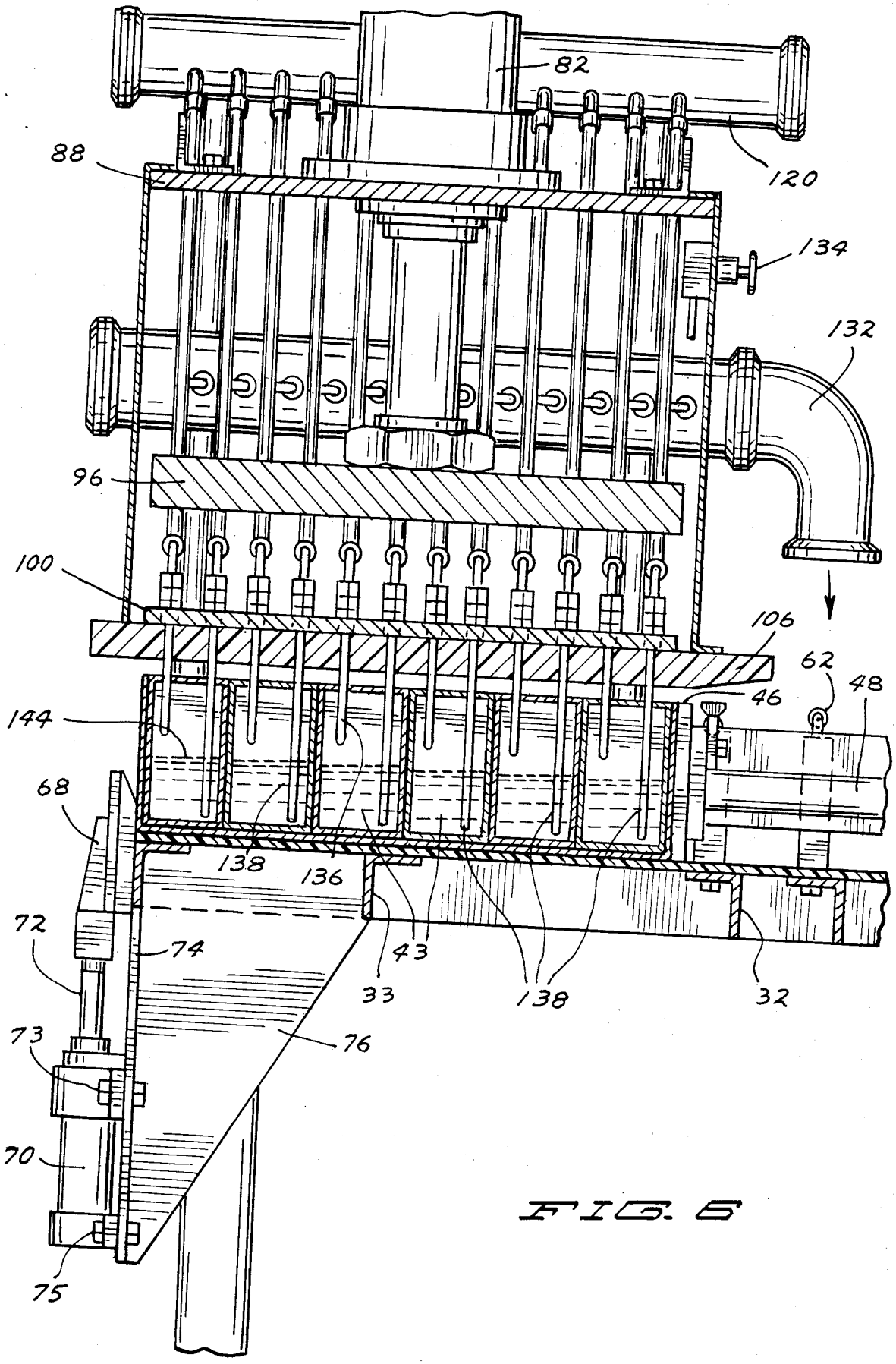
FIG. 6 is an enlarged cross sectional view of a portion of the present apparatus corresponding to FIG. 5 showing the needles in an advanced position, i.e., engaging the beverage packages.

Reference now is made to FIG. 6 wherein the piston rod 94 is shown fully extended. As can be seen, the short needles 136 and long needles 138 have each penetrated the juice packages 43. The long needles 138 extend approximately to the bottom of the packages while the short needles 136 also extend somewhat into the packages 43. The fluid line 144 shows that the distal end 146 of the apparatus is raised slightly such that the entire apparatus is inclined slightly, e.g., about 2°–3° such as by the leveling bolts as described above or other suitable means for inclining the apparatus 10. Such an incline causes the fluid to flow to the side of the package 43 through which the long needles 138 have pierced so as to improve recovery yields. During the exhaust step of operation, air is forced into the package 43 exiting from the short needles 136. The increased pressure causes the juice to flow out through the long needles 138 for recovery.

Figure 7:
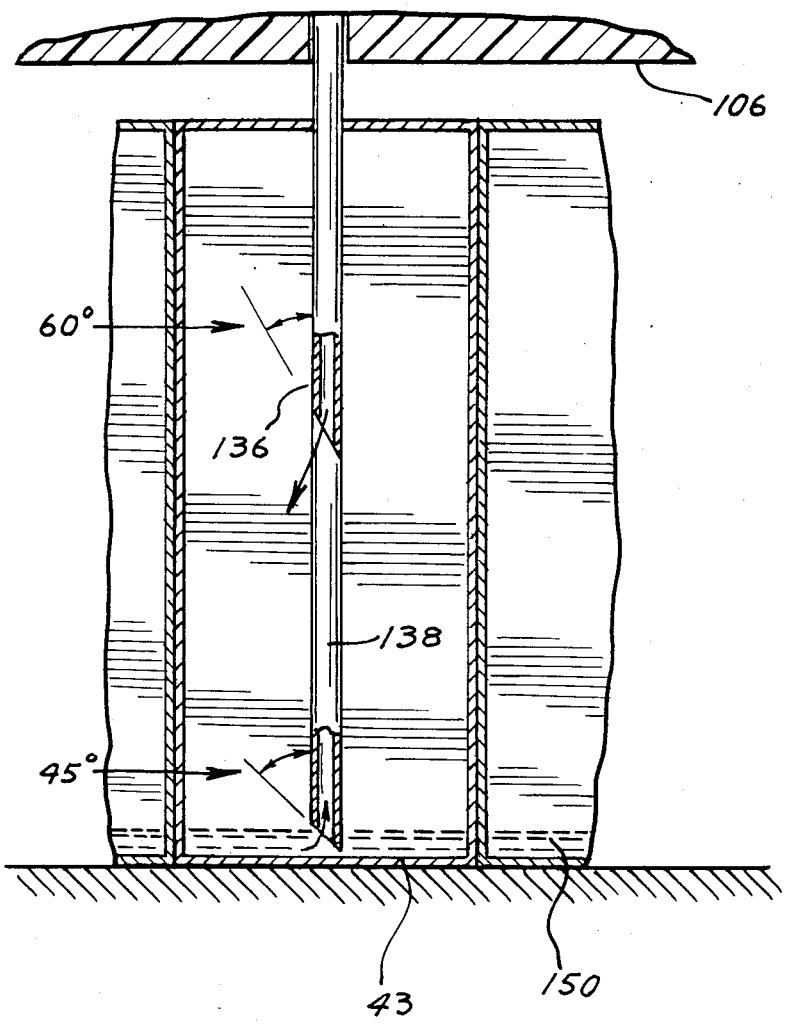
FIG. 7 is a greatly enlarged cross-sectional end view of one beverage package with the needles in the engaged position with one needle in partial relief for the purpose of showing the differing angle at which the needles are cut.

Referring now to FIG. 7, it is seen that in the preferred embodiment, the short needle 136 is cut at a 60° angle to produce a sharper needle. The sharper needle more easily pierces the package 43 with a cleaner hole. The more cleanly the holes are formed, the tighter the seal between the needle and the package. Better sealing is important to reducing bubbling of juice through the holes so formed which, in turn, is important to cleanliness and sanitation. However, the long needles 138 are cut at a 45° angle. Such a cut provides a needle sufficiently sharp to penetrate the package 43. Cutting the long needle at a 45° angle provides for a lower final fluid level 150 than if a sharper 60° angle were employed. By selecting a 45° angle for the long needles 138 as compared to a 60° angle, recovery yield improvements are obtained.

OPERATION OF THE INVENTION

A case 42 is fed to the apparatus 10 whether by hand loading or other case feeding means. If hand loading, then for each cycle of operation, an operator simultaneously presses palm switches 38 and 134. While the pnuematic cylinder advances the case 42, limit switch 62 is contacted by the trip bar 66 causing cylinder 70 to advance the stop plate 68. As the distal end of the case 42 contacts the stop plate 68, the trip bar 66 contacts the third limit switch 64. When the third limit switch 64 is contacted, the cylinder 82 extends lowering the needle platen sub-assembly 80 causing the needles to pierce the cartons 43. At the end of extension of cylinder 82 the fourth limit switch 118 contacts the upper surface of the stripper plate 106 causing the pneumatic controller to allow pressurized air to flow through needles 136 to begin. Thereafter, air is blown through the short needles 136 into the cartons 43 to force the juice out through the long needles 138. The juice flows through the collect lines 133 to the collection manifold 130 and out the exhaust pipe 132. The air supply step is maintained for a preset period, e.g., 15–20 sec., generally sufficient to fully exhaust the juice from the cartons 43. Thereafter, each of the cylinders automatically, simultaneously, and completely retract. Cylinder 82 retracts until the fifth limit switch contacts the under surface of cylinder support plate 88. Simultaneously, forwarding cylinder 44 retracts until the trip bar 66 contacts the first limit switch 60. If the controller 36 has been set on single cycle operation, then the apparatus 10 will come to a stop at the completion of the operation cycle. If however, the controller 36 has been set for continuous cycling, then when limit switch 60 and the fifth limit switch 118 have been tripped, the apparatus 10 will begin a new cycle of operation.

As can be appreciated from the foregoing description, the apparatus 10 conveniently is operated and controlled completely by pneumatic means. If desired, of course, other embodiments can be fabricated with electrically controlled or operated counterparts to the pneumatic apparatus drive and control elements described herein except, of course, for the air supply means to the cartons.

What is claimed is:

1. An apparatus useful in recouping liquids from cases comprising a plurality of individual packages in an array for the liquids, comprising:

A. a frame, including a horizontally aligned case support plate, said frame having a first and second end and means for elevating the frame first end such that the case support plate is at an angle of up to about 3° relative to horizontal;

B. a pneumatic controller mounted on the frame proximate the frame second end, a needle platen sub-assembly mounted on the frame, spaced above the case support plate proximate the frame first end, comprising (1) a horizontally aligned platen plate having a plurality of bores and, (2) a plurality of needle pairs wherein the number of needle pairs equal the number of packages, each pair comprising a first and second needle aligned in the bores, said needles having an upper end extending above and a lower end below the platen plate, said needle pairs arranged in an array corresponding to the array of packages in the case, (3) means for securing the needles to the platen plate, (4) a top support plate parallel to and spaced above the needle platen and a plurality of vertical support members supporting the top support plate from the frame, (5) means for retractably advancing the needle platen sub-assembly in a direction perpendicular to the case support plate, said needle platen advance means being mounted on the frame, such that the needle pair pierce the packages, including a first, double action pneumatic cylinder mounted on the top support plate and pneumatically connected to the pneumatic controller, (6) means for stripping the needles from the case including a plurality of stripper plate vertical support members, a stripper plate spaced above, parallel to, and intermediate the case support plate and the needle platen, said stripper plate being mounted on the stripper plate vertical support members and having a plurality of bores aligned with and equal to the number of needles;

C. means for advancing the case on the case support plate under the needle platen sub-assembly including (1) a second pneumatic cylinder mounted on the frame and pneumatically connected to the pneumatic controller, and (2) an opposed pair of spaced case guides mounted on the case support plate;

D. means for stopping the case advance including a third pneumatic cylinder mounted on the frame first end and pneumatically connected to the pneumatic controller, a case stop plate mounted on the second pneumatic cylinder;

E. an air supply pneumatically connected at one end to the pneumatic controller and attached at its other end to the upper end of the first needle; and F. liquid collection means attached to the upper end of the second needle.

2. The apparatus of claim 1 wherein the air supply includes an air manifold mounted on the frame and air supply lines connected at one end to the air manifold and at the other end to the upper ends of the first needle, wherein the liquid collection means includes a liquid collection manifold mounted on the frame, having a discharge pipe and liquid collect lines connected at one end to the liquid collection manifold and to the upper end of the second needles.

3. The apparatus of claim 2 wherein the stripper plate is fabricated from ultra high molecular weight polyethylene, wherein the first needle has a 60° angle point and the second needle has a 45° angle point, wherein the means for retractably advancing the needle plate further includes a first pneumatic limit switch pneumatically connected to the controller and mounted on the needle platen and projecting downwardly perpendicular to the plane of the platen plate whereby the limit switch is activated by contact with the stripper plate as the first pneumatic cylinder advances and a second pneumatic limit switch pneumatically connected to the controller and mounted on the needle platen and projecting upwardly perpendicular to the plane of the platen plate.

4. The apparatus of claim 3 wherein the frame elevation means includes a pair of leveling bolts mounted on the first pair of vertical support members.

5. The apparatus of claim 4 wherein the pair of opposed spaced guides includes one relatively longer member and one relatively shorter member and wherein the needle platen sub-assembly further includes:

(7) a removable housing.

6. The apparatus of claim 5 additionally comprising a switch mounted on the frame and pneumatically connected to the pneumatic controller for initiation of its operation cycle of the pneumatic controller.

7. The apparatus of claim 6 additionally comprising a second switch mounted on the frame and pneumatically connected to the pneumatic controller and wherein the pneumatic controller requires simultaneous activation of the switches to initiate activation of its operation cycle.

* * * * *